US007156274B2

(12) United States Patent
Pufahl

(10) Patent No.: US 7,156,274 B2
(45) Date of Patent: Jan. 2, 2007

(54) MEDIA SEPARATING APPARATUS AND METHOD

(76) Inventor: Joseph A. Pufahl, 10 Bear La., Locust Valley, NY (US) 11560

( * ) Notice: Subject to any disclaimer, the term of this patent is extended or adjusted under 35 U.S.C. 154(b) by 239 days.

(21) Appl. No.: 10/720,046

(22) Filed: Nov. 20, 2003

(65) Prior Publication Data

US 2004/0159692 A1 Aug. 19, 2004

Related U.S. Application Data

(63) Continuation-in-part of application No. 09/376,700, filed on Aug. 17, 1999, now Pat. No. 6,702,170.

(51) Int. Cl.
*B26F 3/00* (2006.01)

(52) U.S. Cl. ..... 225/4; 225/96.5

(58) Field of Classification Search ..... 225/96.5, 225/98, 93; 248/188.4
See application file for complete search history.

(56) References Cited

U.S. PATENT DOCUMENTS

| | | | | |
|---|---|---|---|---|
| 2,148,379 | A | | 2/1939 | McFarland et al. |
| 2,180,837 | A | | 11/1939 | Rudolph |
| 2,246,228 | A | | 6/1941 | Winter |
| 2,555,916 | A | | 6/1951 | Clark |
| 3,101,164 | A | | 8/1963 | Kile et al. |
| 3,182,875 | A | | 5/1965 | Fleming |
| 3,494,523 | A | | 2/1970 | Kalvelage |
| 3,717,292 | A | | 2/1973 | Honeycutt et al. |
| 3,750,989 | A | * | 8/1973 | Bergeson ..... 248/650 |
| 3,777,958 | A | | 12/1973 | Graham |
| 4,195,758 | A | | 4/1980 | Morgan |
| 4,804,319 | A | | 2/1989 | Langner |
| 4,811,545 | A | | 3/1989 | Oxman |
| 5,072,921 | A | | 12/1991 | Golicz |
| 5,144,891 | A | | 9/1992 | McKenna |
| 5,171,717 | A | | 12/1992 | Broom et al. |
| 5,480,083 | A | | 1/1996 | Achelpohl |
| 5,749,550 | A | * | 5/1998 | Jackson ..... 248/188.2 |
| 5,967,472 | A | * | 10/1999 | Wilhelmstatter et al. 248/188.4 |
| 6,098,861 | A | | 8/2000 | Inoue |

* cited by examiner

*Primary Examiner*—Kenneth E. Peterson
(74) *Attorney, Agent, or Firm*—Dilworth & Barrese, LLP

(57) ABSTRACT

An apparatus for separating a stock of semi-compliant material into discrete portions or tags includes a housing having a drive mechanism disposed therein for bending a portion of the semi-compliant material in a first direction thus forming a line of weakening along the material. The drive mechanism subsequently bends the portion of the material in a second direction, which causes the tag to separate from the remaining material along the line of weakening. The present disclosure also includes a method of separating a semi-compliant material into discrete portions or tags which includes the steps of: a) feeding the material into a drive mechanism; b) bending a portion of the material in a first direction thus forming a line of weakening along the material; and c) bending a portion of the material in a second direction thus separating the portion from the remaining material along the line of weakening

5 Claims, 6 Drawing Sheets

MEDIA SEPARATING APPARATUS AND METHOD

CROSS-REFERENCE TO RELATED APPLICATIONS

This is a continuation-in-part application of U.S. patent application Ser. No. 09/376,700 filed Aug. 17, 1999, now U.S. Pat. No. 6,702,170, and incorporated herein by reference.

BACKGROUND

The present disclosure relates to apparatus for separating media from a uniform sheet and more particularly to a separating apparatus, which bends a first portion of a semi-compliant material in at least two directions to separate an individual medium from the remainder of the material. Subsequent media are separated sequentially in a similar manner as the material moves through the separating apparatus.

TECHNICAL FIELD

The advent of thermal printers and the like have revolutionized the industry of efficiently and cheaply inscribing indicia or other identificational material on numerous types of media ranging from clothing, plastics and ceramics to soft/ductile metals such as aluminum. The types of indicia range from simple company logos and company advertising materials to complex bar coding systems which track inventory, expiration dates and consumer spending trends. The printers typically print the indicia on blank continuous sheets or strips, which are fed through the printers and later either stacked in sheets or collected in large rolls for subsequent separation. In order to save on manufacturing costs and to facilitate transportation and storage of the media after it has been imprinted, the indicia is typically repeated (or arranged, e.g., sequenced or grouped) on the sheet or roll and the individual medium are later separated for distribution or use.

Such labels and tags are used by many industries including retail, medical manufactured products and the horticultural industry.

One particular industry which has benefited from the use of the thermal printer is the plant growing industry which typically places plant information tags on various plants to quickly and cheaply identify the various plant varieties and keep an accurate inventory of all the plants in a particular greenhouse or farm. Generally, the plant tags are made from a semi-compliant material such as plastic, which tends to withstand environmental conditions and various pesticides typically used in the floral and plant industries.

As mentioned above, since the manufacturers of plant tags typically imprint the tags on large sheets or rolls for transportation and storage purposes, which must be separated later by the grower, wholesaler, nursery, or florist and placed with the appropriate plants for identification or inventory purposes. As can be appreciated, organizations who typically order these plant tags in the thousands are stuck with the task of manually separating each plant tag from the large sheet or roll before the tags can be used which is both tedious and time consuming.

Typically, the prior art devices of the past have employed complex cutting and scoring systems to separate the tags from the remainder of the material. As can be appreciated, these systems require considerable maintenance, i.e., sharpening of the cutting blades, which can be both time consuming and costly. Some tag manufactures have tried to simplify the manual tag separation process by providing a series of scores or notches along each individual tag on the sheets to facilitate separation. However, although simplified, the manual separation of these plant tags remains tedious and costly.

Thus, there exists a need to develop an apparatus which quickly and easily separates individual medium from a continuous sheet or roll in an efficient manner without requiring frequent maintenance of internal component parts, i.e., sharpening of cutting blades.

SUMMARY

Accordingly, the present disclosure relates to an apparatus for separating a stock of semi-compliant material into discrete portions which includes a housing having a drive mechanism disposed therein which bends the material in a first direction thus forming a line of weakening along the material and subsequently bends the material in a second direction which separates a portion from the remaining material along the line of weakening. Preferably, a feeder feeds the material into the drive mechanism of the housing.

In one embodiment, the drive mechanism includes a plurality of rollers and belts and a variable-speed motor, which controls the speed of the rollers and/or belts of the drive mechanism. Preferably, a series of notches or score marks are disposed at various positions along the material stock to facilitate separation of the tags from the remainder of the material.

In another embodiment, the housing includes at least one drive mechanism, which moves the material stock through the housing about a first flex point and a second flex point. Preferably, the first flex point bends the material in a first direction as the material moves through the housing thus forming at least one line of weakening along the material and the second flex point bends the material in a second direction thus separating the material along the line of weakening into individual portions (tags). Preferably, the drive mechanism includes a belt, which has an inner facing surface treated with a silicon-based or other non-stick finish to facilitate handling and separation. In yet another embodiment, the drive mechanism includes two sets of rollers which are connected by a two belts which carry the material through the housing about the two flex points to separate the tags from the remaining material.

In yet another embodiment, the flex points are selectively adjustable to accommodate for differently-sized material and/or the diameter of the flex points are selectively expandable and contractible to adjust to the dimensions, i.e., width, of the tags. Preferably, the housing has a base disposed on an angle to facilitate dispersement of the tags once separated. The base can also be treated with a silicon-based or other non-stick finish material to also facilitate dispersement of the tags once separated.

Preferably, the drive mechanism includes belts or chains and is driven by a fixed or a variable speed motor which can be independently operated and/or connected to an existing printer, imprinter and/or other fabricating device.

The present disclosure also includes a method of separating a stock of semi-compliant material into discrete portions which includes the steps of:

feeding the material into a housing having at least one drive mechanism which moves the material through the housing;

bending the material in a first direction thus forming a line of weakening along the material; and bending the material in a second direction, which separates a portion of the material from the remaining material along the line of weakening.

BRIEF DESCRIPTION OF THE DRAWINGS

FIG. 6 is an isometric view of a strip of successive tags to be separated by the inventive media separator;

DETAILED DESCRIPTION OF THE PREFERRED EMBODIMENTS

Figure 1:
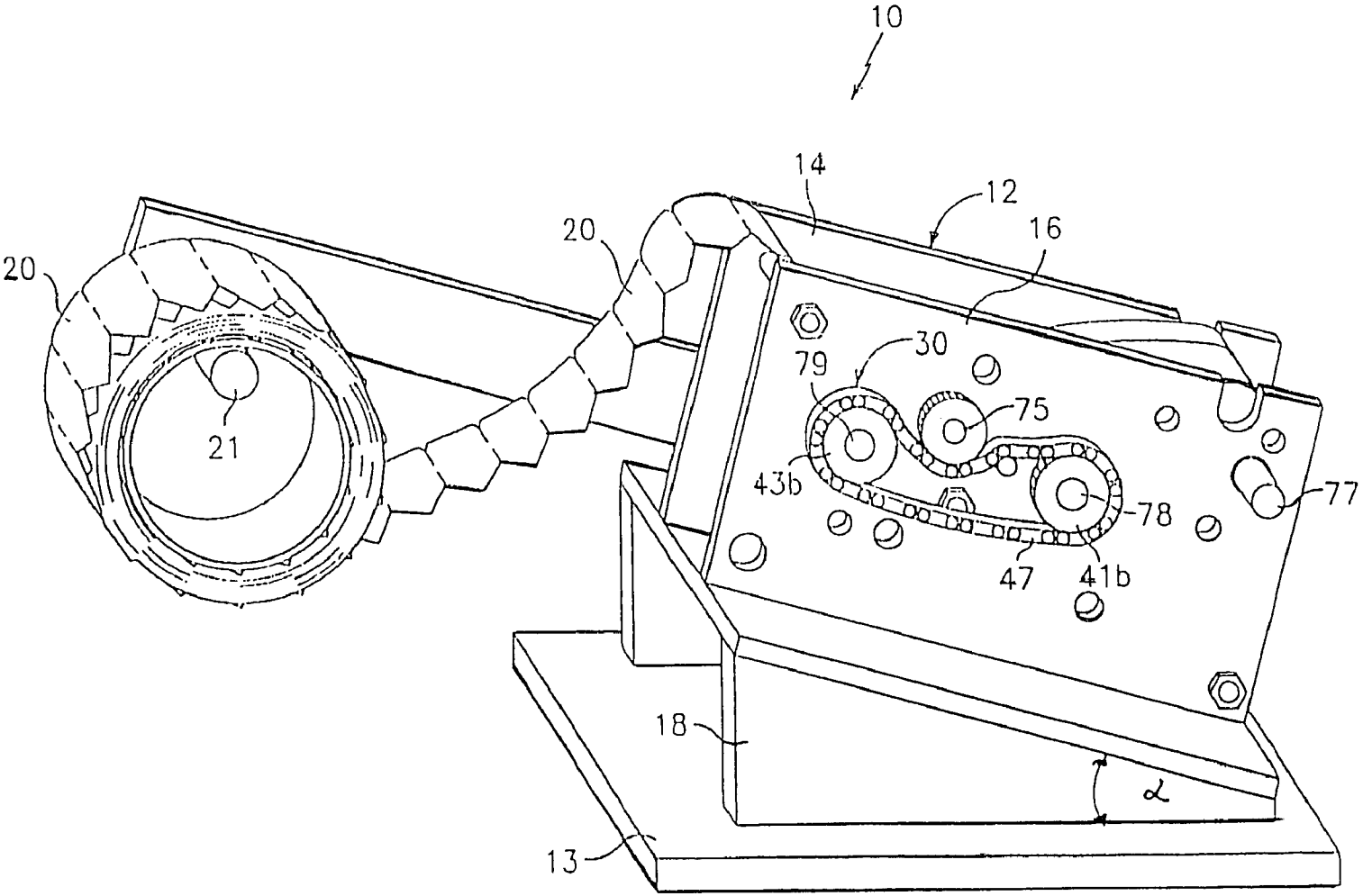
FIG. 1 is a side view of a media separator according to the present disclosure.

The drawings in which like reference numerals identify similar or identical components throughout several views, there is illustrated an apparatus which separates semi-compliant and/or ductile tags from a sheet, continuous strip or roll in a quick, easy and efficient manner. For the purposes herein, the term "semi-compliant material" includes, but is not be limited to, plastic, styrene, vinyl, polyvinylchloride, graphite, kevlar, and/or aluminum. The media separating apparatus is generally identified by reference numeral 10 and includes a chassis/housing 12 having two sides 14 and 16 joined by a common base 18. As best shown in FIG. 1, base 18 is disposed at an angle alpha ($\alpha$) relative to ground 13, which facilitates distribution of the tags 23 once separated from the stock or strip 20 which will be explained in more detail below with reference to the other figures. It is contemplated that angle $\alpha$ can be selectively adjusted depending upon a particular purpose or depending upon a particular type of material being separated.

A drive mechanism 30 is housed between side portions 14 and 16 and can be connected to a manual drive 100, such as a crank handle, for manual operation and/or connected to a motor 50 (See FIG. 3) to automate the separation process. It is also contemplated that the drive mechanism 30 can be engaged with or electrically coupled to an existing drive mechanism associated with a printing or imprinting device, e.g., a thermal printer. In the embodiment shown in the various figures drawings, the drive mechanism 30 includes a pair of drive rollers 31*a* and 33 (See FIGS. 3 and 5) which are each chain driven and are ultimately connected to a crank handle (not shown) or a motor 50 (See FIG. 5) to move the stock through the housing 12. More particularly, a first spindle 75 is rotatably mounted between side 14 and 16 and carries a pair of spindle gears 41*a* and 46*a* at either end which when rotated moves chains 45 and 47, respectively. A second spindle 77 is also rotatably mounted between sides 14 and 16 and carries a spindle gear 43*a*, which is mounted along side 14 to engage chain 45 to form a first drive loop.

Figure 3:
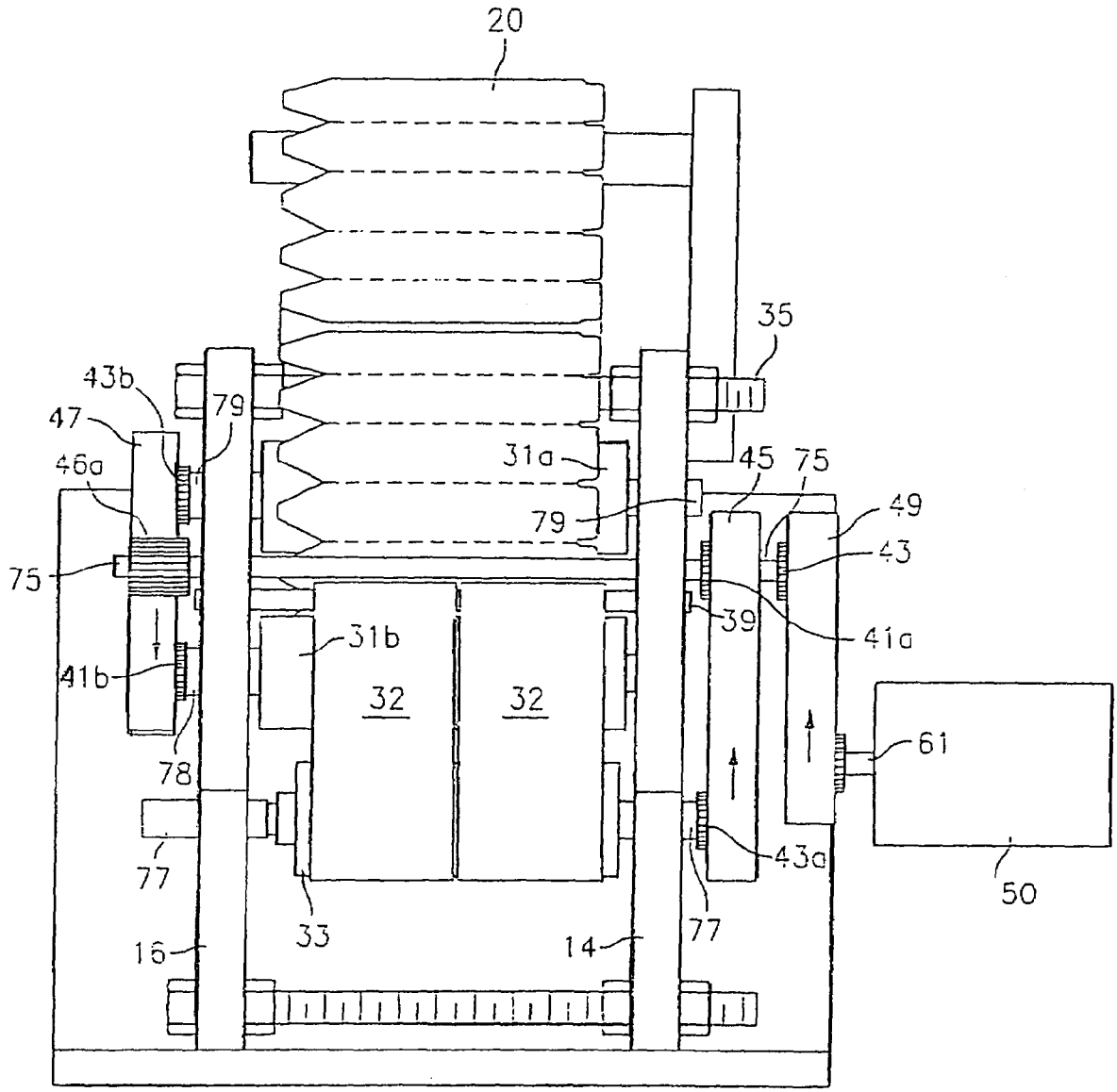
FIG. 3 is a rear, perspective view of the embodiment of FIG. 1.

Likewise, third and fourth spindles 78 and 79 also traverse sides 14 and 16 and carry spindle gears 41*b* and 43*b* at their ends, which engage chain 47 to form a second drive loop. As best shown in FIG. 3, with the exception of spindle 75, each spindle carries a roller, e.g., spindle 77 carries roller 33, spindle 78 carries roller 31*b* and spindle 79 carries roller 31*a*. As can be appreciated, mechanical or automatic rotation of spindle 75 will thus rotate all of the spindles, e.g., 75, 77, 78 and 79 within housing 12, which, in turn, rotates rollers 31*a*, 33*a* and 31*b* to move the stock 20 through the housing as explained in greater detail below.

Drive rollers 31*a* also includes a second spindle gear 43 disposed about spindle 75 on the outer side of spindle gear 41*a* which couples to a second chain 49 which, in turn, engages a drive shaft 61 of motor 50. Rotation of drive shaft 61 causes spindle 75 to rotate and drive the drive mechanism 30. It contemplated that either or both of the drive rollers 31*a* and 33 can be separately connected to a motor(s) 50 depending upon a particular purpose.

Figure 5:
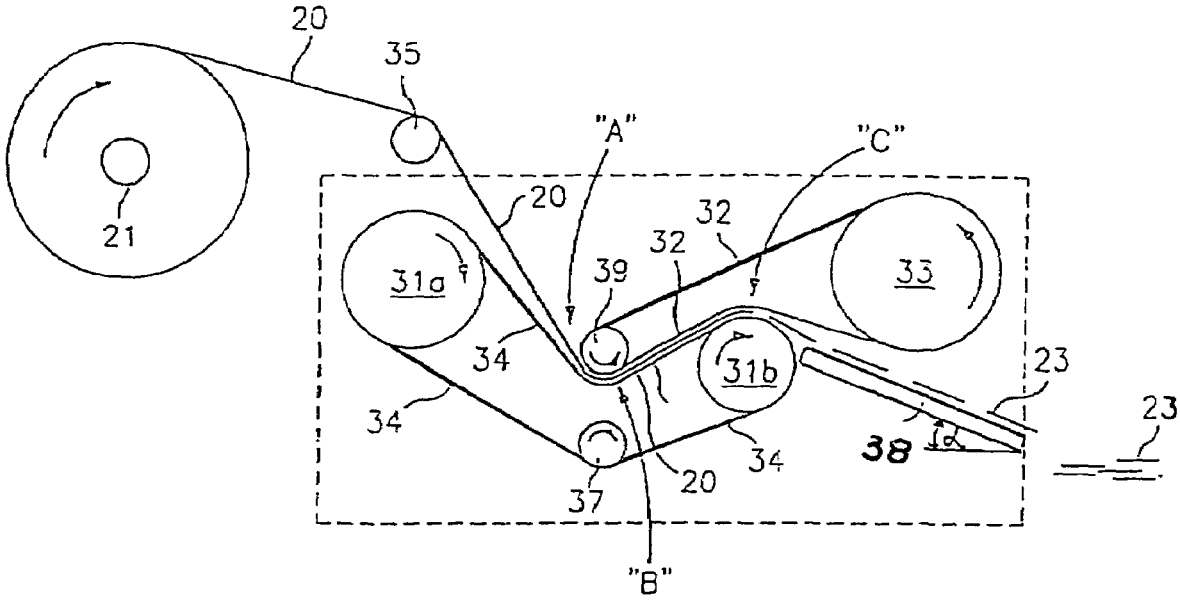
FIG. 5 is a schematic representation the roller configuration of FIG. 4.

As best illustrated in FIG. 5, the drive mechanism 30 also includes a carry roller 31*b*, bearing roller 39 and guide roller 37, which are generally offset relative to one another. Drive rollers 31*a* and 33 are associated with two drive belts 34 and 32, respectively, which form two continuous driving loops around drive rollers 31*a*, 33, carry roller 31*b* and rollers 37, 39 which all cooperate to move the stock 20 through the housing 12. More particularly, the driving loop associated with drive roller 31*a* consists of the following components: drive roller 31*a*, bearing roller 39, carry roller 31*b* and guide roller 37. The driving loop associated with drive roller 33 consists of the following components: drive roller 33, bearing roller 39 and carry roller 31*b*. Preferably, drive rollers 31*a*, 33, carry roller 31*b*, bearing roller 39 and guide roller 37 all move according to the direction of the arrows shown on the FIG. 5 schematic diagram which causes the stock 20 to move through the housing 12. It is contemplated that guide roller 37 and bearing roller 39 can also be arranged to engage chains 45 and/or 47 to ensure consistent motion of the rollers 37 and 39 with the other internal components, e.g., drive rollers 31*a*, 33 and carry roller 31*b*.

Figure 6:
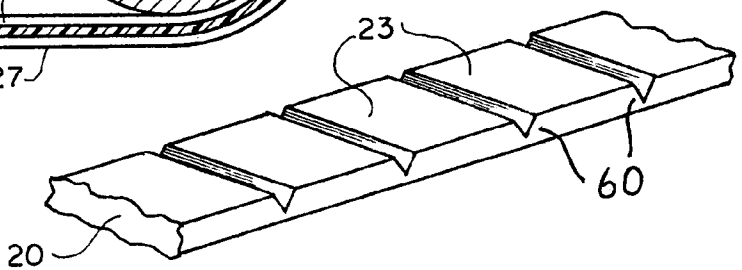
FIG. 6 is an enlarged view of a piece of material stock.

As can be appreciated and as best shown in FIG. 5, the stock 20 is fed off a roll 21 across a feed roller 35 and between belts 32 and 34 which inwardly converge at point "A" as belt 34 moves over drive roller 31*a* and belt 32 moves over bearing roller 39, respectively. The stock 20 then trapped between the two belts 32 and 34. As the stock 20 moves over roller 39, the stock 20 bends in a first direction as the stock 20 rotates around roller 39 at a first flex point "B" to form a line of weakening 60 in the stock 20 between each tag 23 (See FIG. 6). Stock 20 may include a plurality of notches 65 and/or scores 67 which facilitate the formation of multiple lines of weakening 60 along the stock 20 as it rotates about guide roller 39. It is also contemplated that the stock 20 can be preformed with multiple lines of weakening 60 to facilitate bending and separation. Stock 20 can also be manufactured in other fashions which may facilitate separation after printing or imprinting, e.g., pre-scored, indented, hollowed, concave, sunken printed, embossed and/or diecut.

The stock 20 is then guided by belts 32 and 34 towards carry roller 31*b* which causes the stock 20 to bend in a second direction as the stock 20 rotates around carry roller 31*b* at a second flex point "C" which causes the stock 20 to separate along the line of weakening 60 forming individual tags 23. The stock 20 is then released from between the two belts 32 and 34 as the belts 32, 34 continue along their respective driving loops, i.e., belt 34 moves toward and over guide roller 37 and belt 32 moves towards and over drive roller 33. Once released, the individual tags 23 each fall away from the drive mechanism 30 towards angled base 38 where the tags 23 are dispersed to a collection site or carriage belt. It is contemplated that moving air or suction devices can also be employed to disperse or move the tags 23 to a collection site or other desired location.

Preferably, the belts are coated with a silicon-based or other non-stick substance, which facilitates the release of the stock 20 from the belts 32, 34 once separated. It is anticipated that a scraper (not shown) may also be employed to facilitate the release of the tags from the belts 32, 34 once separated.

The present disclosure also includes a method of separating a semi-compliant material into discrete tags which includes the steps of: feeding the material stock 20 into the drive mechanism 30 proximate point "A" (See FIG. 5) which moves the stock 20 through the housing 12; bending the strip or stock 20 in a first direction (at flex point "B") thus forming a line of weakening 60 along the strip or stock 20; and bending the stock 20 in a second direction (at flex point "C") thus separating a tag 23 from the stock 20 along the line of weakening 60.

Separation of the tags 23 depends on a variety of factors including, but not limited to material from which the strip 20 is made, a feed angle ($\beta_1$), at which the strip 20 is delivered to the housing (FIG. 4), an angle ($\alpha$) at which the common base 18 extends relative to a support surface 17, a depth of notches between the tags 23 and, and of course, a position of multiplicity of rollers defining one or more flex points relative to one another.

Figure 4:
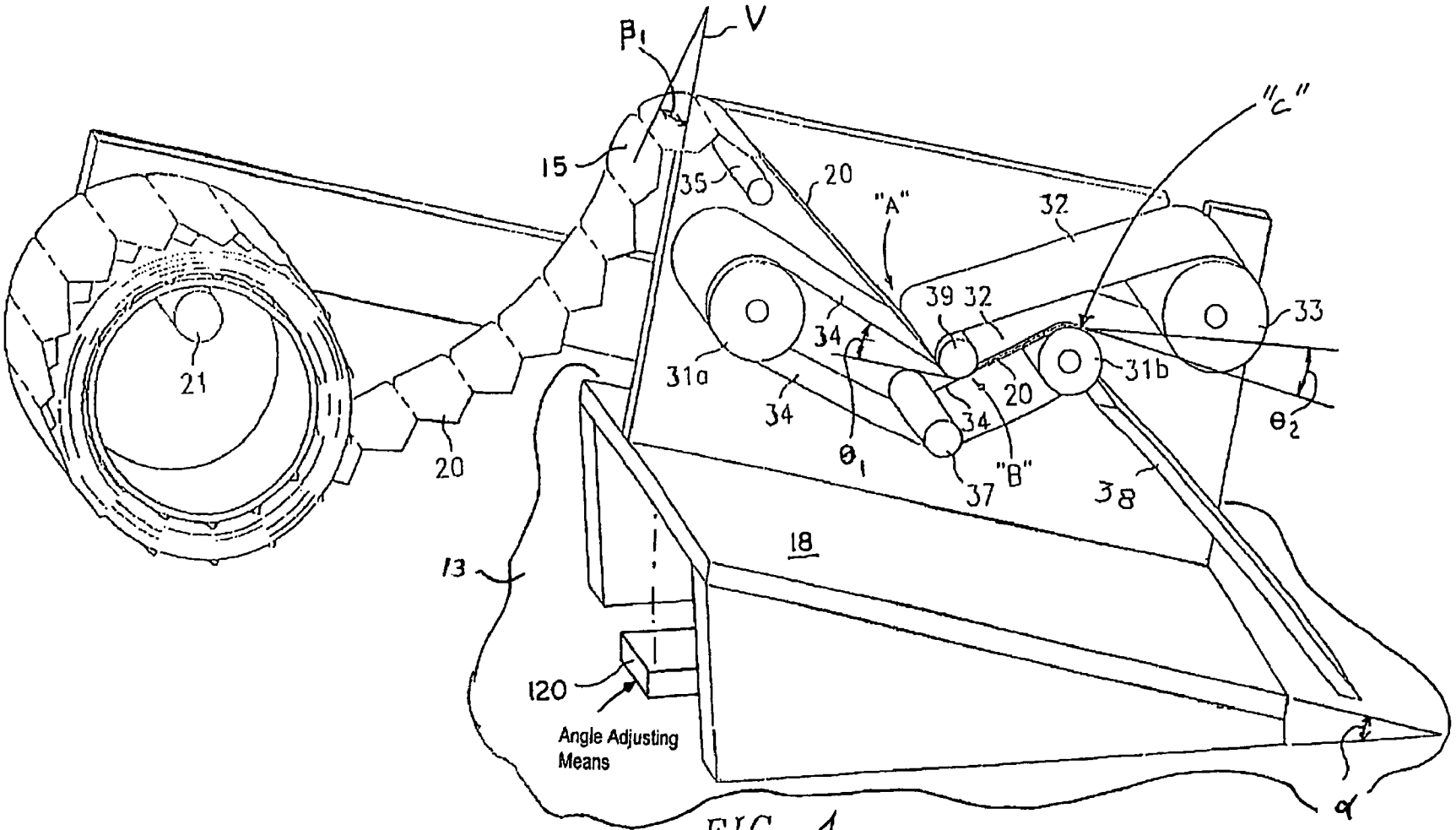
FIG. 4 is a side, perspective view of the embodiment of FIG. 1 showing an internal section of a housing and a driving mechanism.

Referring to FIG. 4, lifting the common base 18 with the housing 12 relative to the support surface 17 causes the feed roll 35 to displace so that the feed angle ($\beta_1$) of the strip 20, defined between a tangent 15 to a curved stretch of the strip 20 and a vertical axis V, progressively changes. As a consequence, the tags 23 guided over the feed roller 35, undergo an initial bending which, by itself, is not sufficient to completely sever the tags, but contributes to a final separation of the tags down a path from the feed roller 35. Displacement of the housing 12 can be realized by a variety of means 120, which are configured to function as a piston and cylinder unit coupled to and displacing the common base 38 to the desired position of the feed roller 35 relative to the roll 21.

Figure 7:
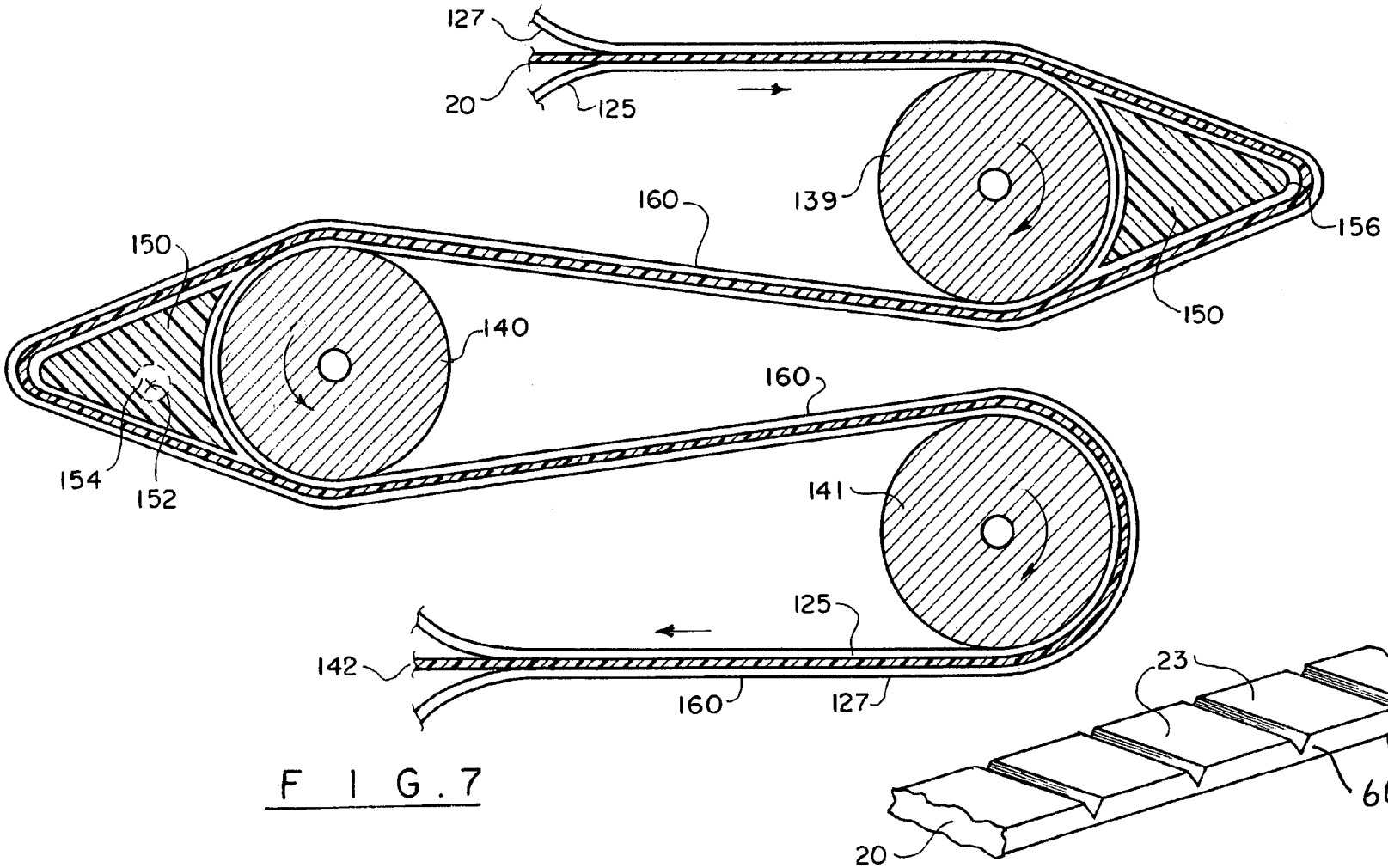
FIG. 7 is a side view of the inventive media separator configured in accordance with another embodiment of the invention.

A further embodiment of the inventive media separating apparatus is illustrated in FIG. 7 and configured to process the strip 20 (FIG. 6) made from relatively flexible material. The configuration of the inventive apparatus having a pair of flex points "B" and "C", as shown in FIG. 4, while efficient to separate the tags made from a relatively rigid type of material, may not be sufficiently effective for the strip made from relatively flexible material. Particularly, angles $\theta_1$ and $\theta_2$ (FIG. 4) formed between the strip 20 and a horizontal at the flex points "B" and "C", respectively, may not be sufficient to bend the strip 20 to the degree necessary to separate the tags.

To address this problem, a further embodiment of the intention, as illustrated in FIG. 7, includes bearing rollers 139, 140 and 141 guiding first 125 and second 127 belts sandwiching the strip 20 along an intermediary stretch of strip path, which has multiple turns each approximating a 180° angle. Merging upstream from the bearing roller 139, the belts compress the strip 20 along upstream and downstream portions 160 of the intermediary stretch and bend it in opposite linear directions along each of the multiple turns to separate the tags 23 (FIG. 6) eventually collected at a downstream station 142. In the device of FIG. 7, having a plurality of substantially 180° turns, each defined by a periphery of a respective one of the bearing rollers 139, 140 and 141 improves the severability of the tags 23 (FIG. 6), even if the latter is made from relatively flexible material.

Figure 2:
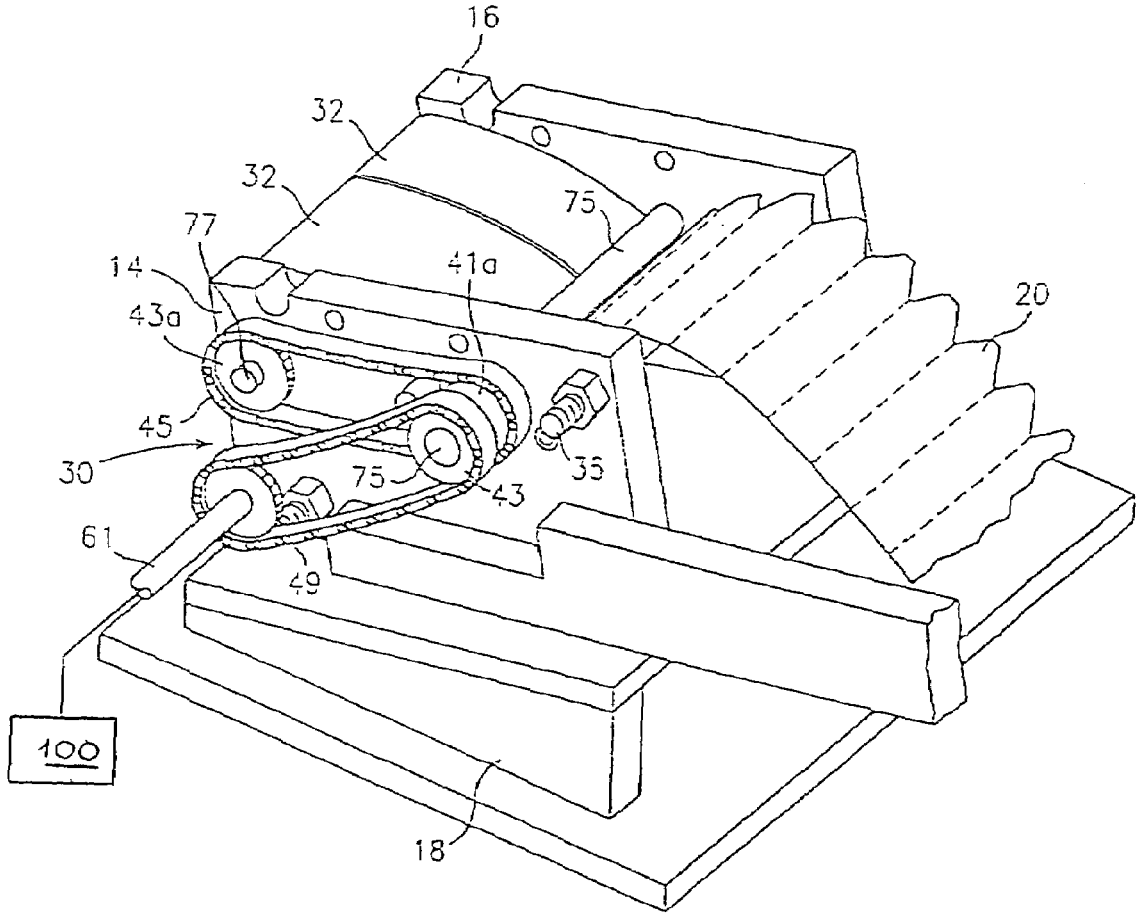
FIG. 2 is a front, perspective view of the embodiment of FIG. 1.

To prevent the slippage of the belts 125, 127 relative to the strip 20, the inventive device is provided with a plurality of guides 150 displaceable relative to the bearing rollers. The guides each may have a respective axle 152 mounted between the sides 14 of the housing 12 (FIG. 2) immediately downstream from a respective one of the bearing rollers 139, 140 and 141. To selectively control the tension applied to the belts, at least one axle 152 is mounted in guide grooves 154 (FIG. 7), which is formed, for example, in the sides 14 of the housing 12 to allow this guide to move relative to the bearing roller 140. Geometry of the guides may vary including, for example, small diameter rollers, or triangularly—or trapezoidally-shaped guides 150 with a curved tip 156, as illustrated in FIG. 7. Preferably, materials utilized for production of the guides have a low friction coefficient. A number of the bearing rollers as well as a number of the guides 150 may vary depending on local requirements, and at least one of the rollers may be provided without the guide 150.

From the foregoing and with reference to the various figure drawings, those skilled in the art will appreciate that certain modifications can be made to the present disclosure without departing from the scope of the present disclosure. For example, it is contemplated that the drive mechanism can include additional drive rollers, carry rollers and guide rollers, which operate to move the strip or stock 20 through the housing. In addition, it is contemplated that additional driving loops can be employed to bend or manipulate the material stock 20 in additional directions depending upon a particular purpose or particular material being separated.

In addition, it is contemplated that any of the rollers, 31*a*, 31*b*, 33, 37 and 39 can be adjustable to increase or decrease the tension associated with each belt and/or to facilitate engagement of the drive belt atop the rollers. Moreover, it is also contemplated that the diameter of guide roller 39 and the diameter of carry roller 31*b* may be expandable or easily changeable to accommodate for tags having larger or smaller widths. Moreover, although spindle gears and chains are shown in the drawings for regulating and synchronizing the rotation of the various rollers, other mechanisms may be employed to achieve the same result, e.g., belts, pulleys, wires and/or electrically synchronized motors.

While the present disclosure has been generally described and shown as a stand alone unit, it is contemplated that the media separating apparatus 10 can be affixed to or removable engaged with a thermal printer or other imprinting/stamping device.

While particular embodiments of the disclosure have been described, it is not intended that the disclosure be limited thereto, as it is intended that the disclosure be as broad in scope as the art will allow and that the specification be read likewise. Therefore, the above description should not be construed as limiting, but merely as exemplications of preferred embodiments. Those skilled in the art will envision other modifications within the scope and spirit of the claims appended hereto.

What is claimed is:

1. A method of separating a strip of semi-compliant material into discrete portions, comprising the steps of:

a) providing an apparatus having angle adjustment means for establishing a desired feed angle of the semi-compliant material into a housing positioned at a support angle from a support surface, said angle adjustment means including an actuator for adjustably moving the housing to a desired support angle, wherein the desired support angle of the housing is oblique to the support surface;

b) adjustably moving the housing to the desired support angle to establish the desired feed angle of the semi-compliant material into the housing;

c) feeding the semi-compliant material into the housing having at least one drive mechanism which moves the semi-compliant material through the housing;

d) bending the semi-compliant material inside said housing in a first bending direction, thereby forming a line of weakening along the semi-compliant material; and e) bending the semi-compliant material inside said housing in a second bending direction opposite to the first bending direction, thereby separating a portion of the semi-compliant material from the semi-compliant material along the line of weakening.

2. The method according to claim 1, wherein the step of bending the semi-compliant material occurs along substantially a 180° turn along each of the first and second bending directions.

3. The method according to claim 2, further comprising the steps of:

guiding a first belt along a first path;

guiding a second belt along a second a path;

merging the first and second belts between upstream and downstream stretches of the first and second paths, thereby forming an intermediary stretch common to the first and second path;

sandwiching the strip of the semi-compliant material between the first and second belts along the intermediary stretch, the intermediary stretch having an upstream portion running into at least one downstream portion upon making the 180° turn, so that the upstream and at least one downstream portions of the intermediary stretch extend in substantially opposite linear directions within the housing.

4. The method according to claim 3, further comprising the steps of mounting a plurality of bearing rollers to the housing to guide the belts and the strip along the intermediary stretch, and mounting a plurality of guides to the housing along the upstream and at least one downstream portions of the intermediary stretch so that each of the guides is located downstream from a respective one of the bearing rollers and is shaped to guide the strip of semi-compliant material sandwiched between the belts along a respective substantially 180° turn.

5. The method of claim 1 wherein the actuator includes a piston and cylinder.

* * * * *